United States Patent [19]

Echols, Sr.

[11] 3,978,629

[45] Sept. 7, 1976

[54] THERMAL BARRIER CURTAIN WALL

[75] Inventor: Charles W. Echols, Sr., College Park, Ga.

[73] Assignee: The William L. Bonnell Company, Newnan, Ga.

[22] Filed: Apr. 16, 1975

[21] Appl. No.: 568,480

[52] U.S. Cl. ..... 52/235; 52/309; 52/395; 52/461

[51] Int. Cl.[2] ..... E04H 1/00

[58] Field of Search ..... 52/235, 403, 395, 464, 52/309, 208, 461, 495, 463

[56] References Cited

UNITED STATES PATENTS

| | | | |
|---|---|---|---|
| 3,071,215 | 1/1963 | Gall | 52/395 |
| 3,357,145 | 12/1967 | Grossman | 52/235 |
| 3,488,906 | 1/1970 | Brooks | 52/395 X |
| 3,553,918 | 1/1971 | Dauson | 52/235 X |
| 3,798,869 | 3/1974 | Nipp | 52/309 X |

*Primary Examiner*—Ernest R. Purser
*Assistant Examiner*—Carl D. Friedman
*Attorney, Agent, or Firm*—Donald L. Johnson; John F. Sieberth; Paul H. Leonard

[57] ABSTRACT

An improved curtain wall or wall system for building construction is provided which employs a unitary thermal barrier or thermal break vertical mullion. The novel unitary vertical thermal barrier mullion comprises metal exterior and interior vertical members uniquely joined together, and an insulating medium, or member further joining and separating the metal members. The members are so constructed that a fail-safe condition is provided which prohibits complete separation of the metal members should the insulating member or medium subsequently lose its structural integrity. The shape of the mullion may be varied without changing the construction providing the fail-safe condition.

24 Claims, 4 Drawing Figures

THERMAL BARRIER CURTAIN WALL

BACKGROUND OF THE INVENTION

The present invention relates to a new and improved wall system or curtain wall and more particularly to vertical members or mullions employed therein. A unitary thermal barrier of a fail-safe construction is provided.

In the construction of modern day multi-story buildings, a variety of wall systems or curtain wall structures have been utilized. U.S. Pat. Nos. 3,719,014 and 3,858,375 are illustrative of these types of construction.

Generally these curtain walls are constructed of metal framing members with extruded aluminum members being preferred for many installations. The various components of the wall system are factory fabricated and transported to the job site. Vertical and horizontal members are constructed in predetermined shapes and lengths. These members are assembled piece by piece into a grid directly on a building. The grid is then glazed from either the inside or outside of the building depending upon job conditions. Spandrel panels or other types of panels may be installed along with the metal members if desirable A number of wall systems employ various types of thermal grid barriers or thermal breaks in the grid or frame members as well as a thermal break between the panel members and the grid or frame members to prevent heat transfer from one member to the other. Present methods require the use of thru bolts, approximately 10 to 12 inch centers isolated with rigid plastic to provide structural strength for the thermal break. Such procedure necessitates a great amount of labor for fabrication and assembly in the plant or on the job site as well as added material costs. After installation of the curtain walls or wall system, there is always the risk that the barrier material will lose its structural integrity, either partially or wholly, because of uncontrollable influences such as elevated temperatures caused by a fire inside or adjacent to the wall system. When structural integrity is lost, it is likely that glass or other panels comprising the wall system will fall from the building.

It is therefore a primary object of the present invention to provide an improved curtain or wall system for buildings which provides for a fail-safe condition whereby complete separtion of metal members is prohibited.

Another object of the invention is to provide a novel wall system wherein the various components thereof may be quickly and easily installed from the inside of the building without the necessity of employing thru bolts or similar fastening devices.

Still another object of the instant invention is to provided an improved unitary thermal break vertical mullion or frame member for curtain walls or wall systems which is completely fabricated at a plant or shop thereby eliminating the expense and risk entailed with job site assembly.

Another important object of the present invention is to prevent a short circuit of the thermal break wherein horizontal mullions or framing members are isolated from vertical mullions by the use of suitable hard thermal materials attached to appropriate locations on the vertical mullions or to the ends of the horizontal mullions.

Other objects and advantages of the invention will become more readily apparent from a consideration of the following description and drawings.

SUMMARY OF THE INVENTION

The invention relates to a curtain wall or wall system for buildings of the thermal barrier or thermal break type. More particularly, the invention comprises a unitary fail-safe vertical mullion or framing member.

The vertical mullion comprises an exterior metal member and an interior metal member joined together and separated by an insulating member or insulating elements to form a unitary mullion, with the members so constructed and so joined together that should the insulating member or elements subsequently lose structural integrity, complete separation of the metal members is prohibited.

In one form of the mullion, the exterior member or shape has a T-shaped stem which is adapted to slidably mate with a semi-hollow construction in the interior member or shape. An opening is provided in the semi-hollow interior which is sufficiently large to readily and easily receive the base or leg member of the T-shaped stem, and which is smaller than the cross-section width of the cross-bar or top member of the T-shaped stem. Such construction prevents lateral separation of the metal members after they have been slidably mated with each other. After the metal members are mated together, a suitable thermal barrier material such as a urethane foam is foamed in place so as to fill the semi-hollow portion of the interior mullion and surround the portion of the T-shaped stem therein. Solidification of the thermal barrier material provides a unitary mullion for curtain walls. After installation on a building, such construction places the thermal barrier material in a state of compression rather than tension when stress is placed upon the mullion by either positive or negative wind loads. For low density foams, plastic spacer blocks may be required and these can be positioned in the semi-hollow of the interior metal member at appropriate locations. The shape or face of the exterior portion of the exterior metal member and of the interior portion of the interior metal member may be varied as desired.

In another feature of the invention which prevents a short circuit of the thermal break, thermally improved or thermal break metal horizontal mullions of any desired shape are isolated from the vertical mullions by the use of a suitable hard thermal material suitably attached to the vertical mullions or to the ends of the horizontal mullions.

In another form of the vertical mullion, suitable rigid pre-formed thermal barrier spacers or isolators are employed. The T-shaped stem of the exterior member is somewhat modified wherein serrated pockets or channels are formed at the end of the cross-bar for receiving the insulating member. Corresponding pockets or channels are formed in the interior metal member also for receiving the insulating members. The spacers are so constructed as to be received by the channels in the exterior and interior members. Mating of the metal and insulating members is accomplished by employing a force fit utilizing suitable equipment such as a break press.

In a further embodiment of the vertical mullion, suitable rigid pre-formed thermal barrier insulating members or spacers are also employed of a somewhat different construction. The T-shaped stem of the exterior member is modified wherein the ends of the cross-bar are somewhat arrow-shaped in cross-section. The plastic spacers have suitable openings or channels therein for receiving the arrow-shaped ends of the cross-bar. The spacers occupy the cavity of the semi-hollow portion of the interior member. Such spacers may extend longitudinally the length of the metal members or may be in the form of short members spaced apart periodically with distances therebetween being determined by desired or required structural strength. End portions of the members of the interior metal member forming the semi-hollow cavity are so constructed that they may be rolled back or stitched over the spacers. After the spacers are slidably mated on the T-shaped stem of the exterior shape and in the semi-hollow of the interior shape, the end portions of the semi-hollow framing members are rolled back on the spacers, firmly locking them in position to form the unitary vertical mullion.

In the alternative forms of the vertical mullion, the interior face of the interior member is preferably of an open type construction for ease in assembling the exterior and interior metal members and insulating members and to facilitate installation of the mullion on a building. With this type of mullion, a snap-on back member is provided for appearance or structural reasons and to serve as a retainer and aligner of the mullion unit.

In each form of the invention, the cross-section width of the cross-bar of the T-shaped stem of the exterior member is of a wider dimension than the opening in the interior member for receiving the leg of the T-shaped stem of the exterior member. Once the exterior and interior members are mated with each other, this construction prohibits lateral separation of the metal members. When the metal members and insulating member or members are joined together, a unitary thermal break structural member is a fail-safe construction is provided.

After the vertical and horizontal mullions and appropriate panels are installed on a building frame, a wall system or curtain wall is formed which provides a complete thermal barrier between temperatures on each side of the wall.

This invention accordingly comprises the features of construction and the combination of elements and arrangements of parts as exemplified in the construction hereinbefore and hereinafter described.

BRIEF DESCRIPTION OF THE DRAWINGS

The invention will be more readily understood from a reading of the following specification and by reference to the accompanying drawings forming a part thereof, wherein examples of the invention are shown, and wherein.

Similar reference characters refer to similar parts throughout the several views of the drawings.

DESCRIPTION OF THE PREFERRED EMBODIMENT

Figure 1:
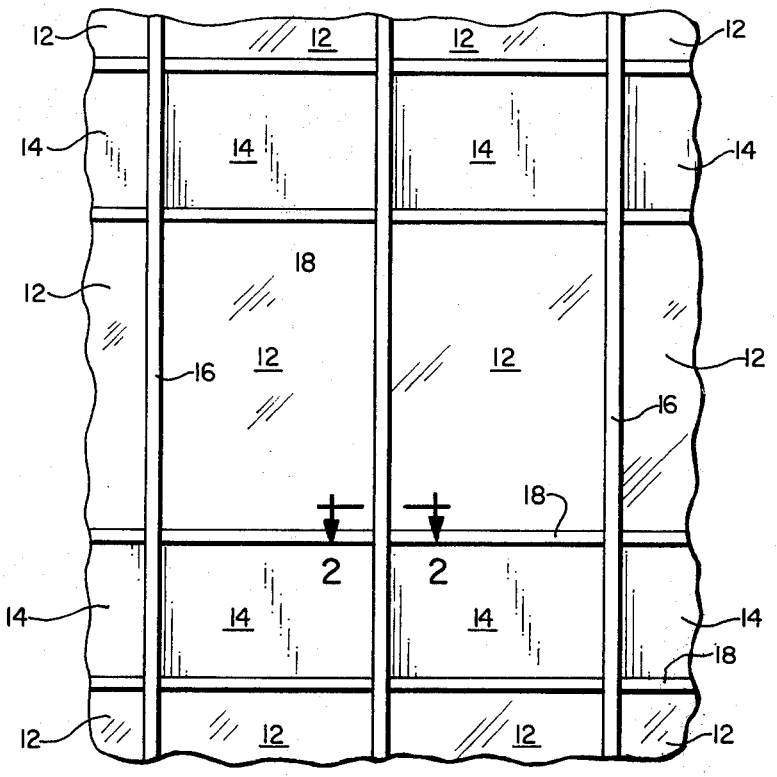
FIG. 1 is a front view of an assembled curtain wall or wall system.
Figure 2:
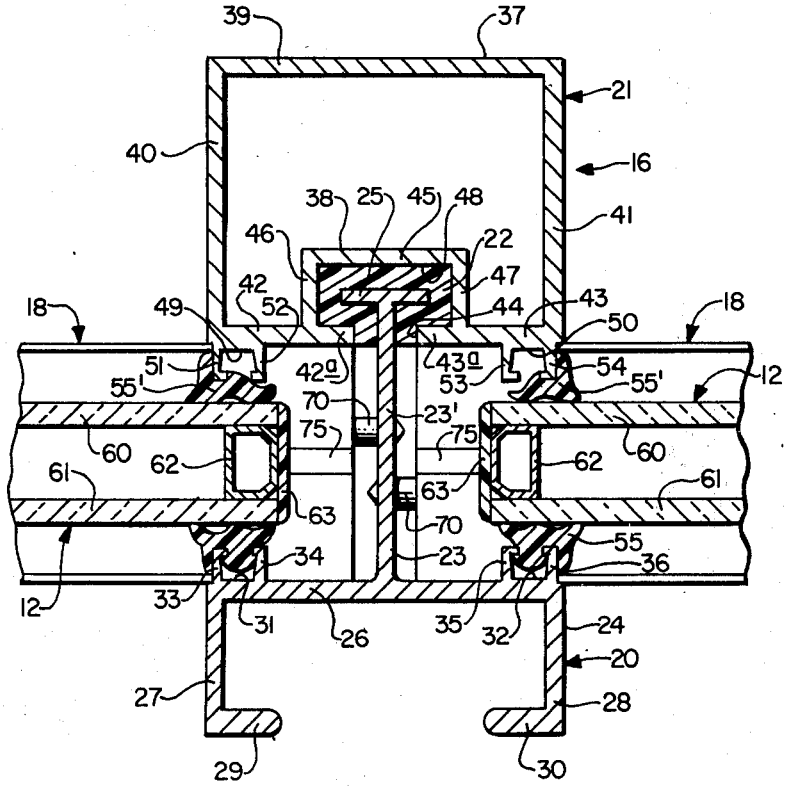
FIG. 2 is a cross-sectional view taken along line 2—2 of FIG. 1.

Referring now to the drawings, and particularly to the embodiment of FIGS. 1 and 2, there is illustrated a portion of a wall system or curtain wall, generally indicated at 10. The wall 10 comprises a plurality of fixed windows or vision glasses 12 and spandrels or panels 14 arranged in side-by-side co-planer relation within a plurality of vertical framing members or mullions 16 and horizontal framing members or mullions 18. The curtain wall is mounted on a building frame or framing structure (not seen) by suitable fastening devices such as bolts and nuts, rivets, etc. It can be appreciated that the curtain wall may comprise all glass panels, all spandrels or other panels or mixtures thereof of various dimensions and that vertical and horizontal mullions are spaced in accordance therewith and as structural requirements and appearance may dictate.

In FIG. 2, a preferred form of the novel vertical mullion or curtain wall framing member 16 is seen in cross-section. The mullion 16 comprises three basic elements or parts, an exterior member or shape 20, an interior member 21 and a thermal barrier or insulating member 22. The exterior and interior members are metal and aluminum extrusions are preferred. The insulating member is plastic or other suitable material with a foamed in place urethane foam of relatively high density being preferred.

The exterior member 20 is a one-piece construction and comprises a T-shaped stem 23 and a channel member 24 extending from the base of the stem. The stem 23 includes leg or support member 23' and cross-bar 25 on one end of the leg. The channel member 24 includes base member 26, a pair of members 27 and 28 which extend perpendicularly and outwardly from the base 26, and a pair of foot members 29 and 30 which extend perpendicularly from the members 27 and 28, respectively and toward each other. Such foot members are also parallel to base 26. As illustrated, the channel member 20 provides a track or channel for receiving and guiding a rail on a scaffold or other equipment adapted to be used by various types of workmen on the side of a building. It can be appreciated that the channel 24 or face of the member 20 can be of a variety of shapes dependent upon the end use thereof and the esthetic appearance desired. A pair of gasket channels 31 and 32 are provided on each end of the base 26. Channel 31 is formed by somewhat L-shaped projections 33 and 34 and channel 32 is formed by similarly constructed L-shaped projections 35 and 36. The construction of channels 31 and 32 may also be varied as required or desired.

The interior metal member or shape 21 is also of unitary construction and is also preferably an extruded aluminum shape and includes a rectangular frame or box-like member 37 and a smaller rectangular or semi-hollow member 38 within the larger frame. Frame 37 includes side member 39, side members 40 and 41 extending perpendicularly from each end of member 39 and parallel to each other, and short side members 42 and 43 which extend perpendicularly and inwardly from one end of members 40 and 41, respectively. The members 42 and 43 are in alignment with each other and parallel to side member 39 and extend toward each other so as to provide a gap or opening 44 therebetween. The semi-hollow or smaller box-like member 38 includes side member 45 and shorter side member 46 and 47 which extend perpendicularly from each end of the member 45 and are perpendicularly joined to members 42 and 43, respectively at an intermediate position thereon. The opening 44 also serves as the opening into the larger opening 48 formed by the sides of semi-hollow member 38 and end portions 42*a* and 43*a* of the members 42 and 43, respectively. Gasket channels 49 and 50, similar to gasket channels 31 and 32, are provided on one end of members 42 and 43, respectively. Channel 49 is formed by somewhat L-shaped projections 51 and 52 and channel 50 is similarly formed by L-shaped projections 53 and 54. The construction of channels 49 and 50 may also be varied as desired or required.

In forming the vertical mullion 16, the members 20 and 21 are slidably mated with each other and held in the position illustated in FIG. 2. A suitable thermal barrier or insulating material such as a polyurethane foam is foamed in place so as to fill the openings 44 and 48 thus forming the thermal break member 22.

Although the overall size and strength of the members 20 and 21 may be varied, depending upon structural requirements, panel sizes or other factors, it is essential that the width of the cross-bar 25 be greater than the width of the opening 44 and that the members 20 and 21 have sufficient structural integrity that lateral separation of the members 20 and 21 from each other is substantially prohibited.

When the mullion is assembled, gasket channels 31 and 32 extend towards or face channels 49 and 50, respectively and are sufficiently spaced apart to permit the insertion of a panel 12 and gaskets 55 and 55′ therebetween.

Horizontal mullions 18 and thermally insulated glass panels 12 are of standard commercial construction or of any other desired or suitable constructions. Aluminum extrusions are preferred. It is only necessary that they be of sufficient structural integrity for the end purpose desired and that when a curtain wall is completed they provide the desired thermal break.

Thermally insulated glass panels 12 comprise a pair of glass panes 60 and 61 separted by spacers 62 with a sealing gasket 63 extending around the periphery of the panel. Such types of panels are of standard construction and are well known in the art.

To isolate the horizontal mullions from the vertical mullions and to prevent a short circuit of the thermal break, upon curtain wall assembly, suitable hard thermal material "pop-in" buttons 70 are attached to the leg 23′ of the vertical mullion 16 by any suitable means, such as openings of a proper size, adhesive or other means. The buttons, or other suitable types and shapes of insulating materials, may also be attached to the ends of the horizontal mullions and by any suitable means. The buttons may be made of nylon, Delrin or other suitable insulating materials. When attached to the leg 23′ the buttons are so located thereon as to provide separation between the leg 23′ and horizontal mullions positioned on each side thereof. The buttons are also longitudinally spaced periodically on the leg 23′ at appropriate locations depending upon the number of horizontal mullions to be adjacent thereto.

The shape of the inside of the interior member 16 as represented by sides 39, 40 and 41 may be varied as design or structural requirements may necessitate. Such inside or interior may also be constructed as illustrated in FIGS. 2A and 2B and as will be explained more fully hereinafter.

In assembling a complete curtain wall, vertical mullions 16 and horizontal mullions 18 are attached to a building frame in any suitable manner such as bolts, rivets or other means. The mullions may be quickly and easily installed from the interior side of the building thus providing safety for erectors as well as providing reduced costs. Panels 12 and spandrels 14 are positioned in glazing pockets in the horizontal mullions in a customary manner with horizontal spacers 75 of any suitable insulating material positioned between the panels and the horizontal mullions separating them therefrom each other. The spacers 75 may be constructed of any suitable material such as nylon, Delrin, etc. In installation of the panels, glazing gaskets 55 are locked in position first, then the panel inserted in the horizontal and vertical mullions. Subsequently, glazing gaskets 55′ are installed. Gaskets 55′ are constructed so that they may be rolled in thus sealing the panel in position.

Figure 2A:
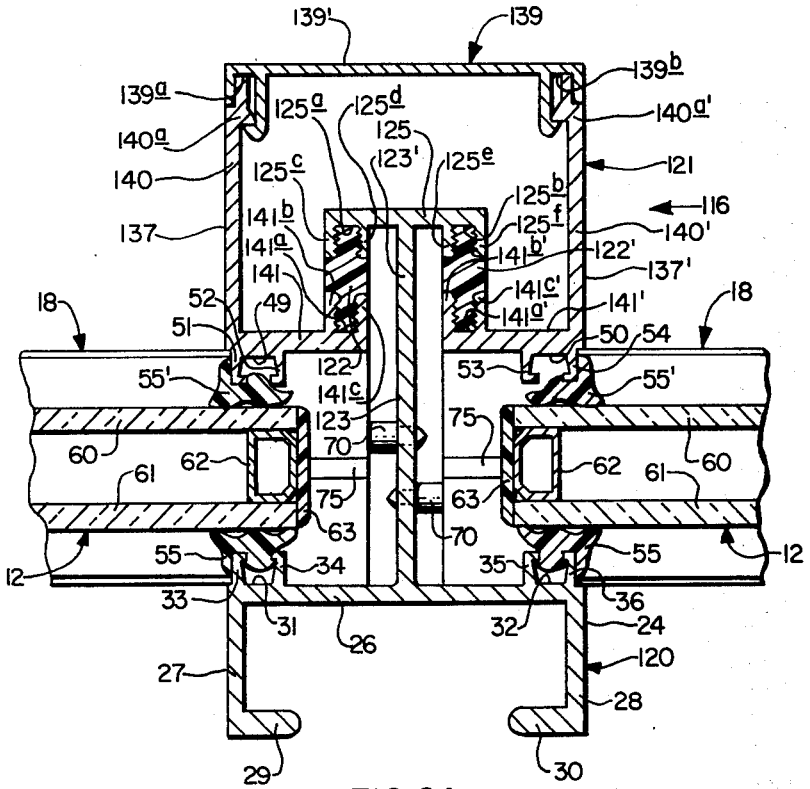
FIG. 2A is a view similar to that of FIG. 2, but of an alternate embodiment of the invention; and, FIG. 2B is a view similar to that of FIG. 2, but of another embodiment of the invention.
Figure 2B:
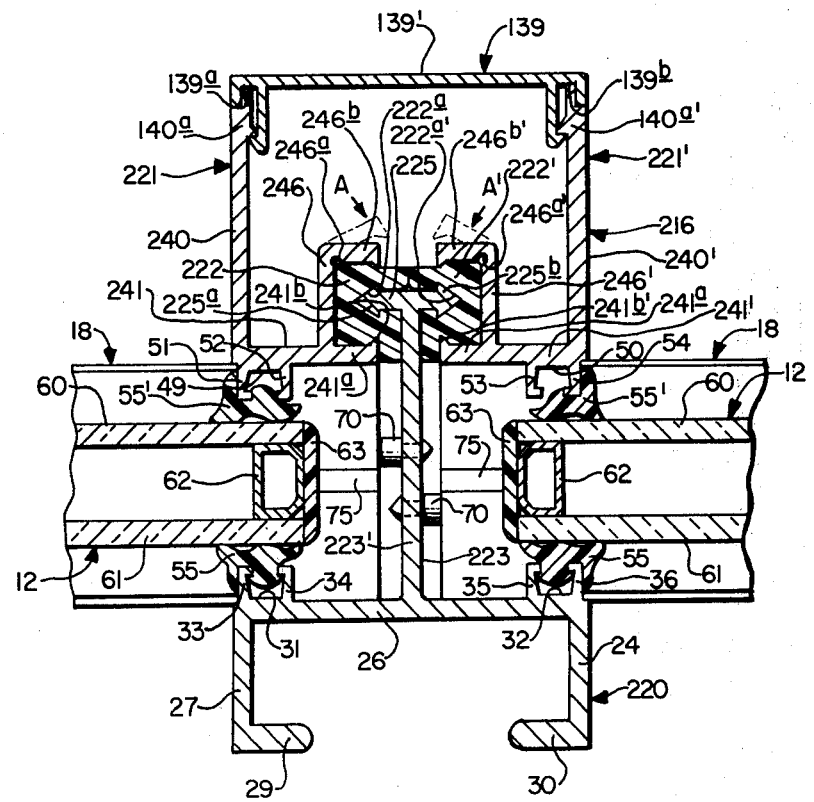

In FIGS. 2A and 2B, alternate constructions of the novel thermal barrier vertical mullions of this invention are illustrated. The metal members are also preferably aluminum extrusions or shapes. In the embodiment of the invention as illustrated in FIG. 2A, the exterior member 120 comprises channel member 24 and a T-shaped stem 123. The stem 123 includes leg or support member 123′ and cross-bar 125 on one end of the leg. A pair of spacer or insulating barrier channels 125*a* and 125*b* are provided on each end of the cross-bar 125. The channel 125*a* is formed by perpendicular projections 125*c* and 125*d*. Channel 125*b* is similarly formed by perpendicular projections 125*e* and 125*f*.

The interior metal member or shape 121 includes a pair of somewhat "L"-shaped members 137 and 137′. The member 137 includes side member 140 and side member 141 extending perpendicularly from one end thereof. The member 141 has a serrated spacer receiving channel 141*a* on the end thereof formed by perpendicularly extending projections 141*b* and 141*c*. Member 140 also has an end portion 140*a* thereon for lockedly receiving a snap-on back retainer or aligner plate 139. Member 137′ is constructed similarly to member 137 and includes a member 140′ and a member 141′ extending perpendicularly from the end thereof. Like the member 141, the member 141′ has a serrated channel 141′*a* on the end thereof formed by perpendicularly extending projections 141′*c*. The member 140′ also has an end portion 140′*a* for lockedly receiving the plate 139.

In forming the vertical mullion 116, preformed spacers 122 and 122′ are inserted in the channels 141*a* and 141′*a*, respectively of the members 140 and 140′, respectively, and in the channels 125*a* and 125*b* of the cross-bar 125. The exterior member 120 is thus joined with the interior member 121 by the spacer 122 and 122′ to form the unitary thermal break vertical mullion 116.

After the vertical mullion 116 is installed on a building in a customary manner, plate 139 is snapped on to the mullion of 116.

The plate 139 comprises base member 139′ and locking channels 139*a* and 139*b* on each thereof which are adapted to mate respectively with the end portions 140*a* and 140′*a*, respectively. It can readily be appreciated that various constructions of the plate 139, locking channels 139*a* and 137*b*, and end portions 140*a* and 140′*a* can be made as design and structural requirements dictate without departing from the scope of the invention. The remainder of the construction of the mullion 116 is similar to that of the mullion 16.

Another embodiment of the unique vertical mullion of the instant invention is illustrated in FIG. 2B. The mullion 216 comprises a unitary exterior member or shape 220, a pair of interior members 221 and 221' and a pair of spacer or insulating members 222 and 222'. The spacers are preformed from any suitable insulating material, such as nylon, Delrin, etc., and may be in the form of short blocks or continuous or elongated shapes.

The exterior member 220 is a one-piece construction and comprises a T-shaped stem 223 and channel member 24 extending from the base of the stem. The stem 223 includes leg or support member 223' and cross-bar 225 on one end of the leg. Each end of the cross-bar 225 has somewhat arrow-shaped projections 225*a* and 225*b* thereon.

The interior metal member or shape comprises two somewhat L-shaped members 221 and 221'. The member 221 includes member 240 and extending perpendicularly therefrom on one end thereof a member 241. A member 246 extends perpendicularly and inwardly from the member 241 and substantially parallel to the member 240 at an intermediate position on the member 241. The member 246 has a groove 246*a* which enables the end portion 246*b* to be moved or bent from a vertical position to a horizontal one as illustrated by the arrow A or from a position about 90° from its original position. The member 241 has an end portion 241*a* thereon which forms a channel along with end portion 246*b* and the other portion of the member 246 for receiving spacer 222. The member 241 also has a small foot portion 241*b* on the end thereof.

The member 221' is constructed similarly to the member 221 and includes member 240' and extending perpendicularly therefrom on one end thereof, a member 241'. A member 246' extends perpendicularly and inwardly from the member 241' and substantially parallel to the member 240' at an intermediate position on the member 241'. The member 246' has a groove 246'*a* which enables an end portion 246'*b* thereof to be moved or bent from a vertical or raised position to a horizontal or lowered position as illustrated by the arrow A'. The member 241' has an end portion 241'*a* thereon which forms a channel along with end portion 246'*b* and the other portion of the member 246' for receiving spacer 222'. The member 241' also has a small foot portion 241'*b* on the end thereof.

Insulating members 222 and 222' are elongated plastic shapes constructed as illustrated in cross-section in FIG. 2B. Each of the spacers has an arrow-shaped channel 222*a* and 222'*a* formed therein for receiving arrow-shaped projections 225*a* and 225*b*, respectively. The spacers 222 and 222' are so constructed and adapted as to substantially fill the semi-hollow or space surrounding the upper portion of leg 223' and cross-bar 225 when the exterior member 220 is mated with the interior members 221 and 221' as illustrated. The remainder of the construction of the mullion 216 is similar to that of the mullion 116.

In assembling the various parts, the exterior and interior members are mated and aligned with each other substantially as illustrated in FIG. 2B. Spacers 222 and 222' are slidably positioned on the member 223 and between the members 246 and 246'. With the spacers in position as illustrated in FIG. 2B, the upper portions 246*a* and 246'*a* are moved or bent toward each other and in the direction of arrows A and A' by rolling, stitching or other suitable means. Whenn the end portions 246*a* and 246*a'* are in position as illustrated in FIG. 2B, the various parts are locked together and a unitary vertical mullion 216 is formed.

The interior face of the interior member 21 may also be constructed similarly to the interior face of interior member 121 wherein retainer or aligner plate 139 is utilized. Other variations of the interior faces of the various constructions as well as variations of the exterior faces of the various embodiments may be made without departing from the scope of the invention.

Although aluminum extrusions are preferred for the interior and exterior members forming the mullions, other types of metals may be used. The term aluminum as used throughout includes aluminum and its various alloys suitable for structural purposes.

Although plastics or similar type materials are preferred for the insulating members or mediums joining the metal members together, other types of suitable insulating materials may be used. Such insulating material should provide the structural or strength requirements necessary for the end use of the mullions or thermal break members.

The novel mullions of this invention may be employed in curtain walls or wall systems for large or small buildings. They may also be used in store-front constructions and other types of construction wherein thermal barriers are desired or required.

In the foregoing specifications and following claims, a T-shaped member is defined as a member which is illustrated in the drawings and described herein as a T-shaped or substantially T-shaped member and as a member or shape which is substantially T-shaped in cross-section.

The term T-shaped member includes any member having a T-shaped end portion without regard to the particular construction on the other end (exterior face) of the member. Such definition also includes any member constructed for a same or similar purpose comprising a leg or support member and a cross-bar or enlarged portion on the end thereof.

Also in the foregoing specification and following claims, the term semi-hollow member is defined as a member (or members joined together) which is illustrated in the drawings and described herein as a semi-hollow or substantially semi-hollow member or shape, and as a member which has a cavity and an opening therein (or which form a cavity and opening therein) for receiving a T-shaped member.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. In a curtain wall or wall framing system for a building or the like including vertical mullions and horizontal mullions, the improvement therein wherein the vertical mullions comprise a metal exterior member and an interior metal member joined together by an insulating member or medium to form a unitary thermal break vertical mullion, insertion means on said exterior member integrally formed therewith for mating with said interior member and receiving means on Said interior member integrally formed therewith receiving said insertion means of said exterior member, said insertion means and said receiving means being adapted to be slidably or longitudinally mated with each other, and when said insertion means and said receiving means are mated with each other, lateral separation of said exterior and interior members is prohibited.

2. The construction of claim 1, wherein said insertion means is a T-shaped member comprising a leg member and a cross-bar member thereon and said receiving means is a semi-hollow member having a cavity therein and a longitudinally extending opening therein for receiving the cross-bar member and the leg member, respectively, of said T-shaped member, said cavity being sufficiently large to receive said cross-bar member and the width of said cross-bar member in cross-section being greater that the opening in said semi-hollow member.

3. The construction of claim 2, wherein said insulating member is a foamed in place insulating material and substantially fills the cavity and opening in said semi-hollow member and surrounds said cross-bar member and the portion of said leg member which are inserted in said cavity and said opening of said semi-hollow member.

4. The construction of claim 2, wherein said cross-bar member has an arrow-shaped projection on each end thereof.

5. The construction of claim 4, wherein said insulating member comprises a pair of rigid spacers adjacent each other and substantially filling the cavity and opening in said semi-hollow member and surrounding said cross-bar member and the portion of said leg member which is inserted in said cavity and said opening of said semi-hollow member, and said rigid spacers having an arrow-shaped opening extending longitudinally on one side thereof for mating with said arrow-shaped projections on said cross-bar member.

6. The construction of claim 1, wherein said insertion means is a T-shaped member comprising a leg member and a cross-bar member thereon, said cross-bar member having a channel on each end thereof adapted to receive an end of an insulating spacer member, said cross-bar channels being parallel to each other and spaced apart therefrom on each side of said leg member of said T-shaped member, said receiving means being a pair of spaced apart somewhat L-shaped members having a channel on one end thereof adapted to receive an end of an insulating spacer, said receiving means channels being parallel to each other and spaced apart therefrom and opposite said cross-bar channels, said insulating member comprising a pair of rigid insulating spacers, said spacers being parallel to each other and spaced apart therefrom on each side of said leg member of said T-shaped member and each of said spacers having one end thereof inserted in a cross-bar channel and the other end thereof inserted in a receiving means channel, thereby forming a unitary thermal break vertical mullion.

7. The construction of claim 1, wherein said exterior member, said interior member and said insulating member of each of said vertical mullions are joined together to form a unitary thermal break vertical mullion prior to installation thereof in said curtain wall or framing system.

8. A unitary thermal break vertical mullion for use in a curtain wall to wall framing system for a building or the like comprising: an exterior metal member and an interior metal member joined together and separated therefrom by an insulating member, insertion means on said exterior member integrally formed therewith for mating with a receiving means on said interior member, receiving means on said interior member integrally formed therewith for mating with the insertion means on said exterior member, said insertion means and said receiving means being so related to each other that when mated with each other, lateral separation of the exterior and interior members from each other is prohibited.

9. The vertical mullion of claim 8, wherein said insertion means is a T-shaped member comprising a leg member and a cross-bar member thereon and said receiving means is a semi-hollow member having a cavity and opening therein for receiving respectively, said cross-bar member and at least a portion of said leg member, said cross-sectional width of said cross-bar member being less than the width of said cavity and being greater than the width of said opening, and said cross-sectional width of said leg member being less than the width of said opening.

10. The vertical mullion of claim 9, wherein said insulating member substantially fills said cavity and said opening in said semi-hollow member and surrounds said cross-bar member and the portion of said leg member extending into said cavity and said opening.

11. The vertical mullion of claim 10, wherein said insulating member is a foamed in place insulating material.

12. The vertical mullion of claim 9, wherein said cross-bar member has an arrow-shaped projection on each end thereof.

13. The vertical mullion of claim 12, wherein said insulating member comprises a pair of rigid spacers having arrow-shaped channels therein for receiving the arrow-shaped projections on said cross-bar member, said spacers being adjacent each other and surrounding said cross-bar member and portion of said leg member extending into said cavity and said opening.

14. The vertical mullion of claim 13, wherein said semi-hollow member comprises a pair of side members bent at substantially right angles toward each other and adjacent said spacers.

15. The vertical mullion of claim 14, wherein said side members have projection means on the end thereof for mating with recessed means in said spacers and said spacers having recessed means therein for mating with said projection means.

16. The vertical mullion of claim 13, wherein said interior member comprises a pair of somewhat L-shaped members facing each other in a parallel spaced apart relationship with each of said L-shaped members comprising a side member and a base member, and said semi-hollow member comprises intermediate members extending from said base member and a portion of each of said base members.

17. The unitary vertical mullion of claim 8, wherein said exterior member, said interior member and said insulating member thereof are joined together to form the unitary thermal break vertical mullion prior to use thereof in the curtain wall or framing system of the building or the like.

18. A curtain wall or wall framing system for a building and the like comprising:

spaced unitary thermal break vertical mullions, said vertical mullions including an exterior metal member, an interior metal member and an insulating member joined to said metal members so as to form a thermal break therebetween, insertion means on said exterior member integrally formed therewith for slidably mating with said interior member and receiving means on said interior member integrally formed therewith for receiving said insertion means of said exterior member, said insertion means and said receiving means being so constructed that when mated with each other, lateral separation of said exterior member from said interior member is prohibited, and said vertical mullions having channels therein for receiving ends of horizontal mullions and for receiving glazing or other panels;

spaced horizontal mullions; and insulating members adjacent the ends of said horizontal mullions and adjacent said vertical mullions and in said channels thereof which form a thermal break or thermal barrier between said vertical mullions and said horizontal mullions.

19. The wall framing system of claim 18, wherein said insulating members comprise a plurality of hard plastic buttons, rivets, blocks or the like attached to said vertical mullions at spaced apart locations thereon and in the channels thereof.

20. The wall framing system of claim 18, wherein said insulating members comprise a plurality of hard plastic buttons, rivets, blocks or the like attached to the ends of said horizontal mullions.

21. The wall framing system of claim 18, wherein said vertical mullions include glazing channels integrally formed on the exterior members thereof and on the interior members thereof and in the panel and horizontal mullion receiving channels thereof.

22. The wall framing system of claim 18, wherein said exterior metal members and said metal members are extruded aluminum shapes.

23. The wall framing system of claim 18, wherein said vertical mullions have an interior face thereof having means thereon for lockedly engaging a plate, a plate for attaching to said face, and means on said plate for lockedly engaging said face engaging means.

24. The wall framing system of claim 16, wherein said exterior member, said interior member and said insulating member of each of said vertical mullions are joined together to form a unitary thermal break vertical mullion prior to installation thereof in said wall framing system.

* * * * *

UNITED STATES PATENT OFFICE
CERTIFICATE OF CORRECTION

PATENT NO. : 3,978,629

DATED : September 7, 1976

INVENTOR(S) : Charles W. Echols, Sr.

It is certified that error appears in the above-identified patent and that said Letters Patent are hereby corrected as shown below:

Column 1, line 26, "desirable" should read -- desirable. --. Column 3, line 36 "interior members" should read -- interior metal members --. Column 3, line 39 "member is" should read -- member of --. Column 4, line 51 "constructed L-shaped" should read -- constructed somewhat L-shaped --. Column 5, line 51 "adhesive" should read -- adhesives --. Column 6, line 47 "projections 141'c" should read -- projections 141'b and 141'c --. Column 6, line 55 "spacer" should read -- spacers --. Column 6, line 62 "each thereof" should read -- each end thereof --. Column 8, line 1 "Whenn" should read -- When --. Column 8, line 65 "Said" should read -- said --. Column 8, line 66 "therewith receiving" should read -- therewith for receiving --. Column 9, line 64 "wall to wall" should read -- wall or wall --. Column 12, line 11 "said metal" should read -- said interior metal --. Column 12, line 18 "Claim 16" should read -- Claim 18 --.

Signed and Sealed this

Fifth Day of April 1977

[SEAL]

*Attest:*

RUTH C. MASON
*Attesting Officer*

C. MARSHALL DANN
*Commissioner of Patents and Trademarks*